US006335974B1

(12) United States Patent
Kunimoto

(10) Patent No.: US 6,335,974 B1
(45) Date of Patent: Jan. 1, 2002

(54) SPEAKER SYSTEM FOR TELEVISION RECEIVER WITH SOUND DUCTS AND PERFORATED PANELS

(75) Inventor: Isao Kunimoto, Saitama (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/035,849

(22) Filed: Mar. 6, 1998

(30) Foreign Application Priority Data

Mar. 19, 1997 (JP) ..... 9-066830

(51) Int. Cl.[7] ..... A04R 25/00

(52) U.S. Cl. ..... 381/306; 381/333; 381/388; 381/365; 381/386; 361/682; 361/683; 181/182; 181/186; 348/789; 348/836

(58) Field of Search ..... 381/306, 333, 381/388, 386, 345, 350, 365, FOR 146; 181/182, 186; 361/682, 683; 348/738, 787, 789, 836

(56) References Cited

U.S. PATENT DOCUMENTS 4,646,349 A * 2/1987 Puls
5,119,429 A * 6/1992 Chatelain
5,166,802 A * 11/1992 Thiele
5,181,247 A * 1/1993 Holl
5,400,408 A * 3/1995 Lundgren et al.
5,452,025 A * 9/1995 Koizumi ..... 381/306
5,822,443 A * 10/1998 Kim
5,868,475 A * 2/1999 Shikata
5,920,637 A * 6/1999 Jeon
6,035,051 A * 3/2000 Sato
6,205,229 B1 * 3/2001 Park

FOREIGN PATENT DOCUMENTS

EP 0492919 A * 12/1991 ..... H04R/5/02
EP 492919 A2 * 12/1991
EP 0598391 A * 11/1993 ..... H04N/5/64
EP 598391 A2 * 11/1993
JP 402312393 * 12/1990
JP 406022385 * 1/1994
JP 07067060 3/1995
JP 07222273 8/1995
JP 08126087 5/1996

* cited by examiner

*Primary Examiner*—Curtis Kuntz
*Assistant Examiner*—Dionne N. Harvey
(74) *Attorney, Agent, or Firm*—Jay H. Maioli

(57) ABSTRACT

An audio apparatus for an equipment relates to an improvement of the sound quality in an acoustic apparatus of the equipment in which for an equipment having a woofer (4) and a tweeter (5), the acoustic apparatus (10) of the equipment includes a panel portion (3) which forms a part of a casing (2) of the equipment and has a plurality of holes (H), a sound conductor (8) which is arranged between the woofer (4) and the panel portion (3), and a buffer member (9) which is provided between the sound conductor (8) and the panel portion (3) and absorbs any woofer vibration.

5 Claims, 6 Drawing Sheets

SPEAKER SYSTEM FOR TELEVISION RECEIVER WITH SOUND DUCTS AND PERFORATED PANELS

BACKGROUND OF THE INVENTION

In recent video equipments such as a display for a television and a computer, in order to expand a displaying area while making a size of a body of the equipment as small as possible or due to a restriction on the designing thereof, the width of a peripheral portion of a cathode ray tube (CRT) becomes small and a space between a cabinet of the video equipment and the CRT also becomes narrow. Thus, speakers are arranged correspondingly to a panel portion of the cabinet formed so as to surround the CRT. In an acoustic apparatus arranged in the space between the CRT and the cabinet which is a casing of the video equipment, the speaker is made small in size. However, making the speaker small causes the sound pressure output from the speaker to generally be lowered and making the panel portion narrow causes the sound quality of the video equipment to be deteriorated. Moreover, arranging the speakers in the vicinity of the CRT may disturb the picture on the CRT due to a vibration of the speaker or the sound wave therefrom.

Furthermore, as shown in FIG. 9A, since the panel portion PA of the conventional acoustic apparatus is directed outwards with respect to a position P of the audience, the nonconformity between a direction R of audience and the advancing direction of the a sound wave S causes the deterioration of the sound quality in the position P of the audience, as shown in FIG. 9B.

Currently, as to the acoustic apparatus of the television set and the like, various devices are made for improving the sound quality.

For example, a part of a horn portion of the speaker is formed by an outer side surface of the CRT and a side wall of the cabinet of the television set. The sound absorbing materials for correcting the sound quality are provided in the horn portion of the speaker unit and an outer wall of the CRT.

There are conventional techniques for improving the sound quality of the speaker system of the video equipment.

The conventional speaker system for the video equipment comprises a speaker for high range sound and a speaker for low range sound, the speaker for the low range sound is fixed on the cabinet having a duct and a pipe. In this way, it is aimed to improve the quality of sound output from the speaker for low range sound.

The conventional television set is arranged so that a speaker fixing member which forms a duct-like sound passage of the speaker is fitted in the cabinet of the video equipment. This allows a large speaker to be installed in a narrow space.

However, in the acoustic apparatus of the conventional television set, there may be such a fear that the magnetic field emitted from the speaker interferes with the CRT, thereby causing the picture to be disturbed. In addition, it is difficult to prevent a slight vibration of the cabinet of the video equipment caused by the speaker's sound.

In the audio apparatus of the television receiver, the magnetic field emitted from the speaker may be conducted to the CRT, thereby also causing the picture on the CRT to be disturbed. It is difficult to prevent the CRT and the cabinet of the television set from vibrating due to the vibration of the speaker and the sound therefrom. Therefore, it is impossible to prevent the deterioration of the picture quality and the generation of the slight vibration, which makes it impossible to improve the quality of the high range sound.

SUMMARY OF THE INVENTION

In view of such aspects, it is an object of the present invention to solve the above problems and to provide an acoustic apparatus for an equipment which is capable of preventing the deterioration of the sound quality due to the vibration of the speaker for low range.

According to the present invention, the above object is accomplished by, in an acoustic apparatus of an equipment having a high range speaker and a low range speaker, the acoustic apparatus of an equipment which is characterized by comprising a panel portion which forms a part of a housing of the equipment and has a plurality of holes, a sound conductor which is located between the low range speaker and the panel portion, and a buffer member which is located between the sound conductor and the panel portion to absorb vibration.

According to the present invention, the sound conductor is fixed through the buffer member to the panel portion which forms a part of the housing the video equipment and has a plurality of holes. The sound output from the low range speaker passes the sound conductor and is then emitted from the panel portion to the audience side. At that time, the vibration generated by the low range speaker is absorbed by the buffer member to prevent a slight sound in the panel portion. In addition, it is possible to prevent a sound from leaking out of the sound conductor due to the presence of the buffer member.

According to the present invention, by arranging the high range speaker in such a manner that the direction of its axis may preferably be coincident with or parallel to the direction of forming the holes in the panel portion, it is possible to output the sound to the audience side without deteriorating the sound quality of the high range sound.

DESCRIPTION OF THE PREFERRED EMBODIMENTS

Now, preferred modes for carrying out the present invention will be described below in detail with reference to the accompanying drawings.

In addition, since the embodiments of the invention described below are preferred embodiments according to the present invention, various and preferable technical limitations are added thereto. However, the scope of the present invention is not limited to these embodiments unless there is a description in which the present invention is particularly limited thereto in the following description below.

Figure 1:
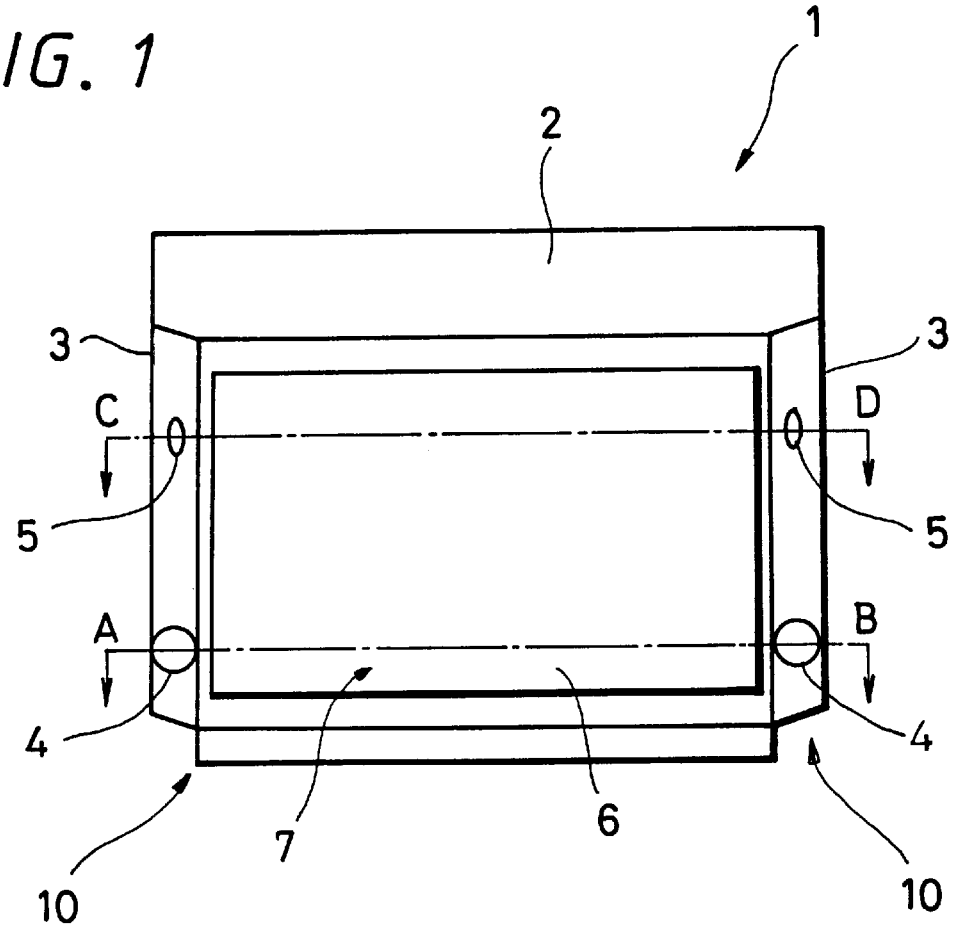
FIG. 1 is a perspective view of an embodiment according to the present invention seen from its upper front.

FIG. 1 shows a preferred embodiment of the acoustic apparatus of the equipment according to the present invention. Referring to FIG. 1, an acoustic apparatus 10 of the equipment according to the present invention will be described.

Figure 2:
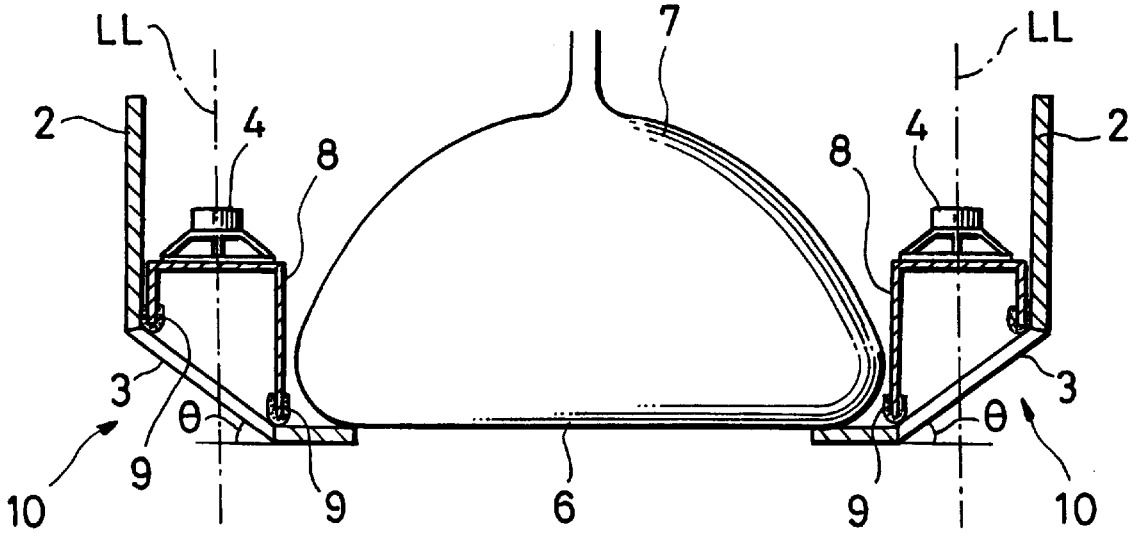
FIG. 2 is a sectional view taken along an line 2—2 in FIG. 1.

FIG. 1 shows an perspective diagram of the embodiment of the present invention where the equipment is a television set (video equipment) viewed from its upper front. FIG. 2 shows a sectional view taken along an 2—2 line in FIG. 1.

The video equipment 1 of FIG. 1 comprises a cabinet 2, a display portion 6 having a cathode ray tube 7, and acoustic apparatus 10, 10 of the equipment and so on.

The video equipment 1 is a display of, for example, the television set or a computer and comprises the cabinet 2. The cabinet 2 of FIG. 1 includes the cathode ray tube 7, the acoustic apparatus 10, 10 of the equipment and the like in the inside thereof. The cabinet 2 of FIG. 1 has right and left panel portions 3, 3 and the panel portions 3, 3 are inclined in opposite directions with respect to the surface of the display portion 6 by an angle θ as is shown in FIG. 2.

At a center of the cabinet 2, there is provided the display portion 6 of the video equipment 1. The cathode ray tube 7 in the display portion 6 can display an image thereon.

Referring to FIG. 1 and FIG. 2, the acoustic apparatus 10, 10 of the equipment will be described in detail.

Each of the acoustic apparatus 10, 10 of the equipment includes the panel portion 3, a woofer 4, a tweeter 5 and so on.

The panel portion 3 is a part of the cabinet 2 which is a casing of the video equipment 1. The woofer 4 of FIG. 1 is positioned on a lower part in the cabinet 2 of the video equipment 1 through a sound conductor 8. The tweeter 5 of FIG. 1 is fixed to an upper part in the cabinet 2 of the video equipment 1.

Figure 3:
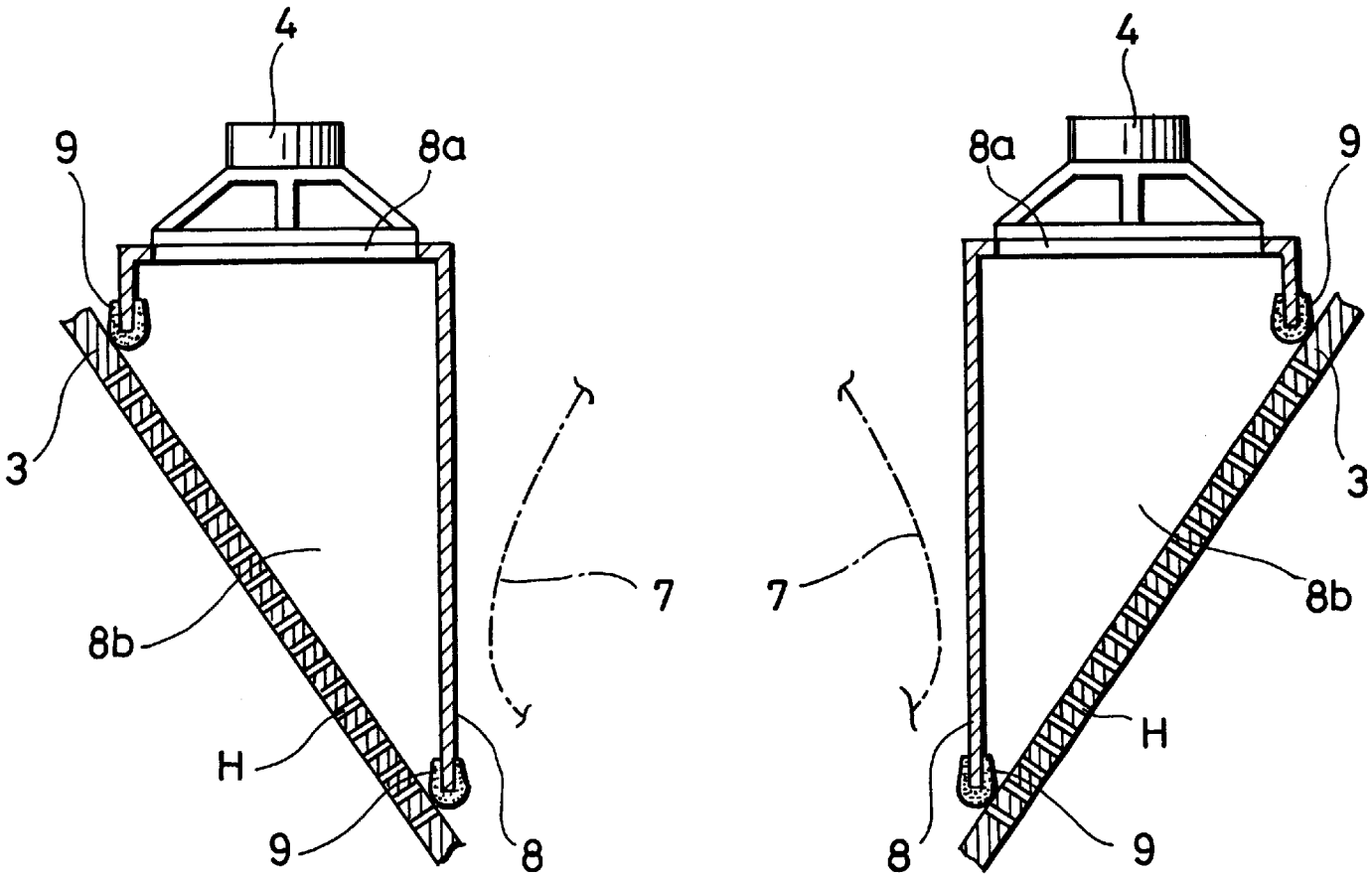
FIG. 3 is an enlarged view of a woofer of an embodiment according to the present invention.

Referring to FIG. 3, the panel portion 3 will further be described in detail.

FIG. 3 shows an arranging example of the woofers 4, 4 in an enlarged scale. The right and left panel portions 3,3 are made of, for example, minute hole processing plastics or metal, etc. and have a plurality of holes H. The holes H of the panel portion 3 are formed by, for example, plastic molding or punching metal and so on. Alternatively, the panel portions 3 can be formed by applying a fabric member to the cabinet 2 in a stretched fashion.

The panel portions 3, 3 are provided so as to decrease the directivity by diffusing the sounds output from the woofer 4 and the tweeter 5, and to reduce a sound pressure difference due to positional difference among the audience.

Referring to FIG. 2 and FIG. 3, the woofer 4 and its peripheral portion will be described.

The woofer 4 is a middle and low range speaker which generates a low sound whose frequency ranges approximately from 100 $H_z$ (Hertz) to 400 $H_z$ (Hertz). The woofer 4 is, for example, a direct emission type speaker and is fixed to the sound conductor 8.

The sound conductor 8 (termed also a duct) of FIG. 2 has, for example, a boxlike form and is interposed between the panel portion 3 and the woofer 4. The woofer 4 is fixed to a rear end opening 8*a* of the sound conductor 8 in FIG. 3 and its front end opening 8*b* is connected or fixed to the panel portion 3 through a buffer member 9.

The sound conductor 8 plays the following role.

Figure 4:
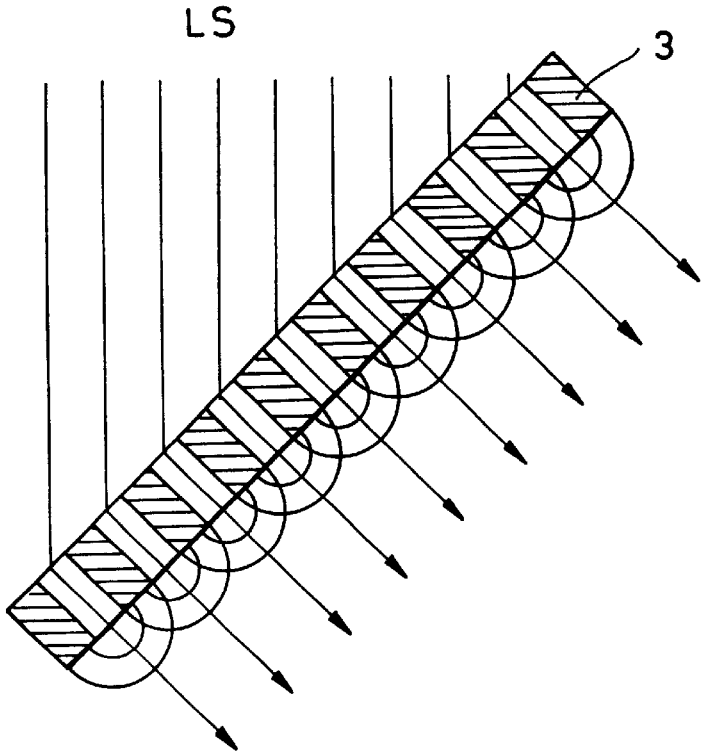
FIG. 4 is a diagram showing the sound wave output from the woofer in the embodiment according to the present invention.

The woofer 4 emits the sound waves to both the front of the woofer 4 and the back of the woofer 4. Since the front and back sound waves are opposite in phase, the sound quality will be deteriorated if they interfere each other. In order that these front and back sound waves may not interfere, the sound conductor 8 is provided. Moreover, as shown in FIG. 4, the sound conductor 8 also plays a role to guide a sound wave LS from the woofer 4 to the panel portion 3 and to prevent the vibration of the woofer 4 from conducting to the cathode ray tube 7 of FIG. 2. Furthermore, using the sound conductor 8 allows the woofer 4 of a large diameter to be arranged in the rear of the CRT 7, where a spacial room exists.

Referring to FIG. 3, the buffer member 9 will be described.

The buffer member 9 is provided on the front end opening 8*b* of the sound conductor 8. The panel portion 3 and the sound conductor 8 are connected without any clearance each other through the buffer member 9. The buffer member 9 is made of materials such as rubber, a sponge, soft plastics or the like. The reason for providing the buffer member 9 is as follows.

The buffer member 9 is arranged so that the vibration of the woofer 4 conducted to the sound conductor 8 may not travel to the panel portion 3 and the CRT 7. In other words, the buffer member 9 prevents the vibration of the sound conductor 8 conducted out of the woofer 4 from travelling to the panel portion 3 and causing the slight vibration, and also prevents the sound generated by the woofer 4 from leaking out of the sound conductor 8.

Moreover, since the buffer member 9 is interposed between the panel portion 3 and the sound conductor 8, it is possible to prevent a gap from being made when assembling the panel portion 3 and the sound conductor 8, which in turn prevents the sound emitted out of the woofer 4 from leaking. Thus, the buffer member 9 plays the role to prevent the deterioration of the sound quality of the woofer 4.

Figure 5:
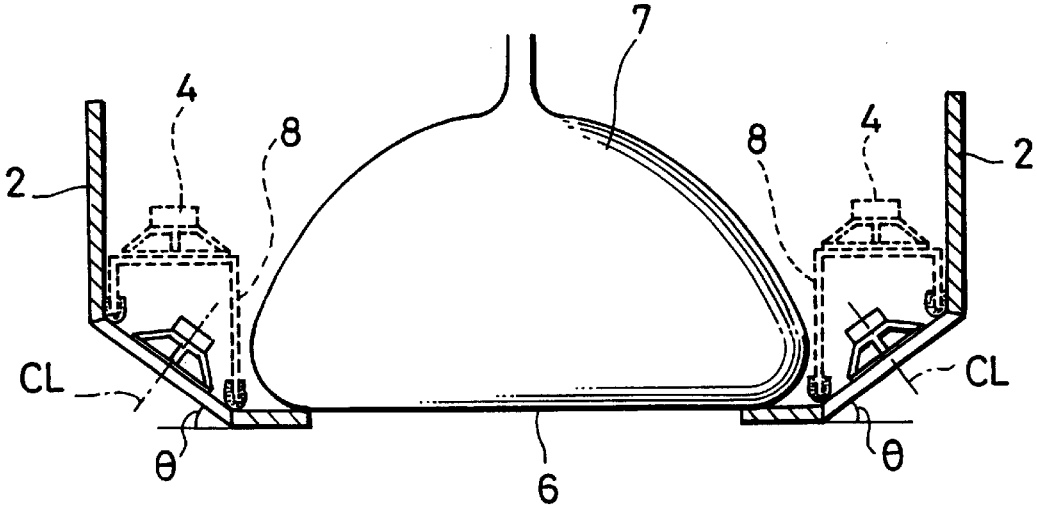
FIG. 5 is a sectional view taken along a 5—5 line in FIG. 1.
Figure 6:
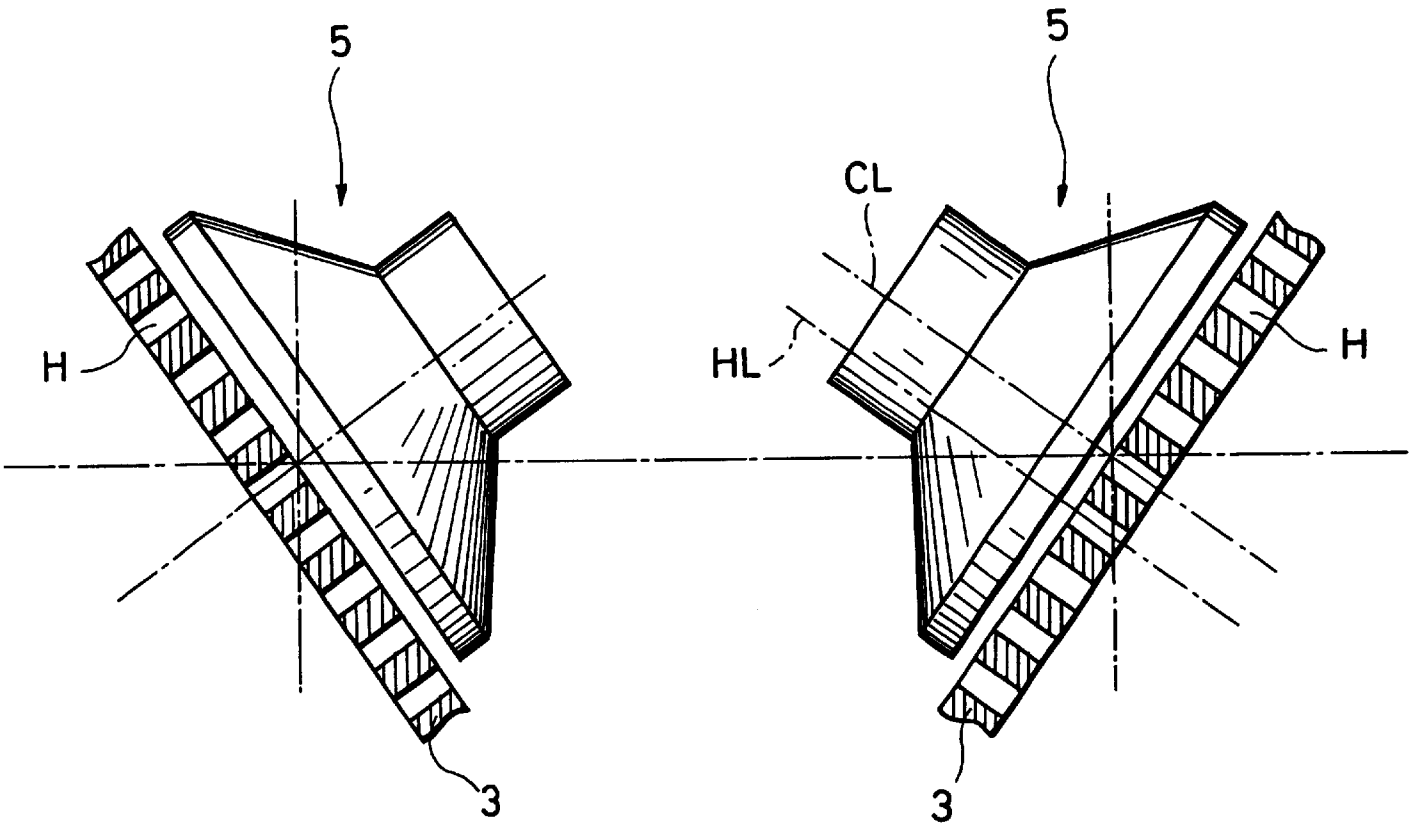
FIG. 6 is an enlarged view of a tweeter of an embodiment according to the present invention.

Referring to FIG. 5 and FIG. 6, the tweeter 5 and its peripheral portion will be described in detail.

FIG. 5 shows a section taken along a C–D line in FIG. 1 and FIG. 6 shows an enlarged view of the tweeter 5 and the panel portion 3.

The tweeter 5 is a speaker which generates a high tone whose sound frequency ranges approximately from 4000 $H_z$ (Hertz) to 20000 $H_z$ (Hertz). The tweeter 5 is provided in association with the panel portion 3 of the cabinet 2 of the video equipment 1. It is installed so that an axis (center line) CL of the tweeter 5 may be parallel to a direction HL of forming the holes H of the panel portion 3. The reason for this is as follows.

A high frequency sound has the feature that its sound pressure is low but its directivity is high. Therefore, the high frequency sound has a drawback that it is hard to hear the sound due to its low sound pressure if there is a large space between the panel portion 3 and the tweeter 5. Also, it has another drawback that, if 9 longitudinal axis of the holes H of the panel portion 3 and the center line (axis) CL of the tweeter 5 are not parallel each other, the sound will not reach the audience due to its high directivity. Accordingly, as shown in FIG. 6, the axis HL of the holes H of the panel portion 3 is arranged to be parallel to the center line CL of the tweeter 5, and the tweeter 5 is installed to have no space between the panel portion 3 and the tweeter 5.

Next, the sound wave LS of the woofer 4 and a sound wave HS of the tweeter 5 will be described.

First of all, the sound wave LS output from the woofer 4 will be described referring to FIG. 4. The sound wave LS output from the woofer 4 in FIG. 4 is guided by the sound conductor 8 and impinges on the panel portion 3. At that time, the sound wave LS having impinged on the panel portion 3 within the sound conductor 8 is refracted by the panel portion 3 and passes the holes H thereof, thus enabling the sound to be heard by the audience.

By forming a closed space in front of the woofer 4 with the panel portion 3, the sound conductor 8 and the buffer member 9, it is possible to make the same low range reproduction as in the case where a speaker box is installed in the rear of the woofer 4, and also to make the amplitude of a diaphragm of the woofer 4 less than the case where it is used in an open space, which in turn makes the vibration conduction toward the CRT to be decreased.

Furthermore, by creating the closed space with the panel portion 3, the sound conductor 8 and the buffer member 9, it is possible to suppress an useless vibration of the speaker unit, thereby allowing the vibration itself to be decreased.

Next, referring to FIG. 7, the sound wave HS output from tweeter 5 will be described.

Figure 7:
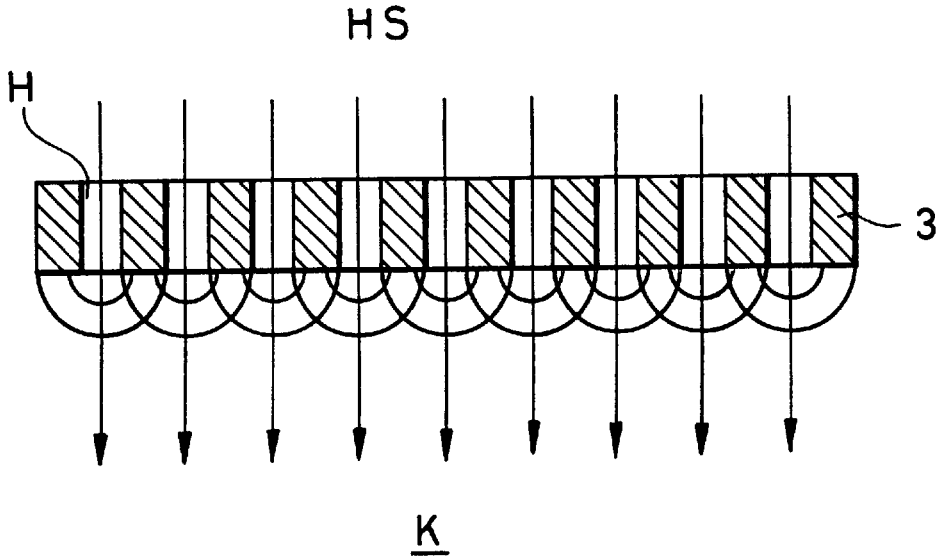
FIG. 7 is a diagram showing the sound wave output from the tweeter in the embodiment according to the present invention.

The sound wave HS output from the tweeter 5 in FIG. 7 passes the holes H of the panel portion 3 and travels in a direction K to the audience.

Figure 8:
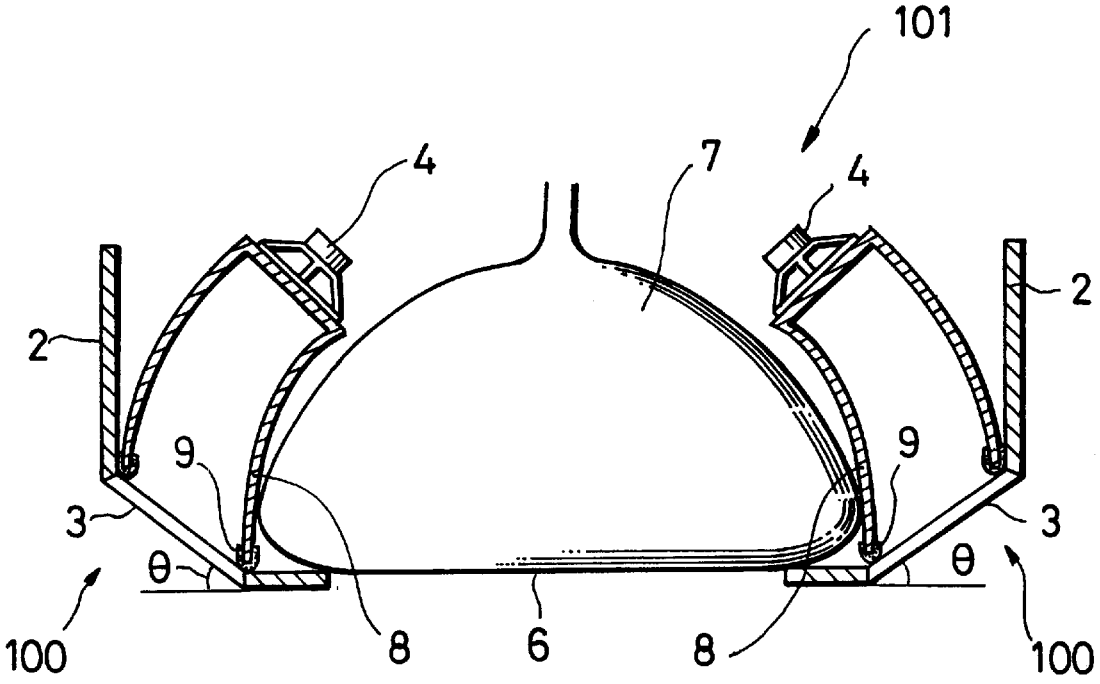
FIG. 8 is a sectional view showing another embodiment according to the present invention.
Figure 9B:
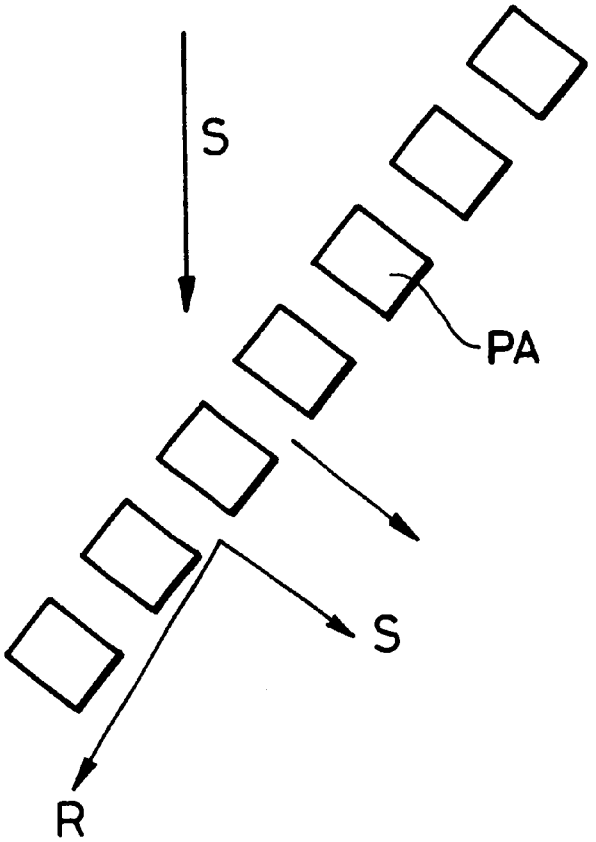
FIG. 9B is a representation of a direction of the audience relative to an advancing direction of a sound wave.
Figure 9A:
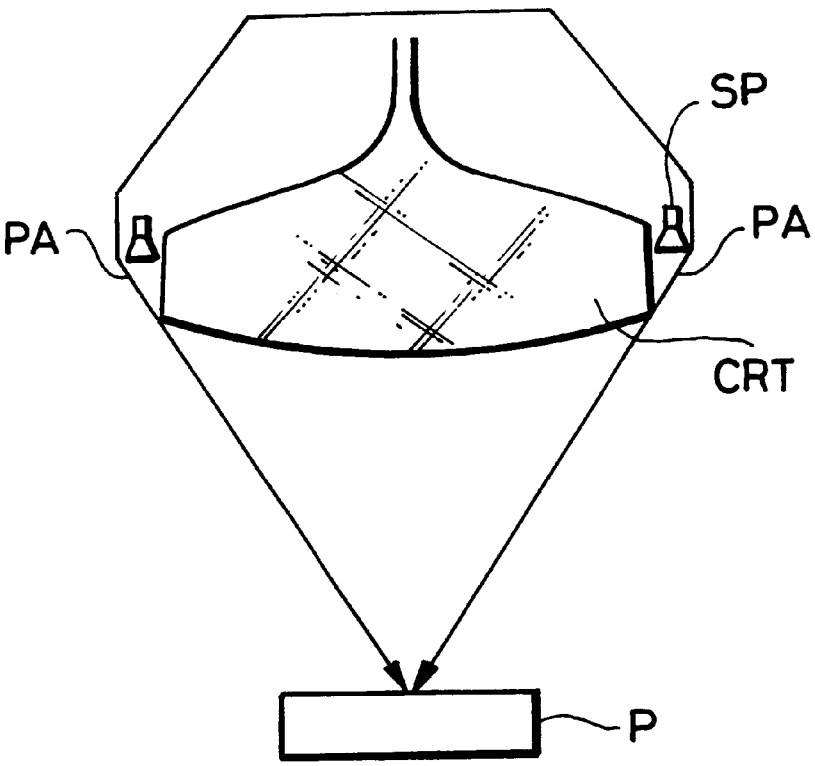
FIG. 9A is a schematic representation of the speakers used with a cathode ray tube relative to an audience.

FIG. 8 shows another embodiment of the present invention.

The equipment of this embodiment is, for example, a television set. An acoustic apparatus 100 for this equipment 101 has nearly the same structure as the acoustic apparatus 10 for the equipment of FIG. 1 and FIG. 2. Therefore, as to structural elements in the acoustic apparatus 100 of the equipment 101 according to the embodiment of FIG. 8, the same elements as those in the acoustic apparatus 10 of the equipment 1 according to the embodiment of FIG. 1 are denoted by the same reference numerals and the description thereof will be omitted.

In FIG. 8, a difference of this embodiment from the embodiment of FIG. 1 and FIG. 2 is that the sound conductor 8 is bent approximately along the outer circumferential surface of the CRT 7. In this manner, by arranging the woofer 4 in the rear of the CRT 7, where there is comparatively a spacial room, it is possible to adopt the woofer 4 of a large diameter for the acoustic apparatus 100 of the equipment 101.

As described above, according to the embodiments of the present invention, it is possible to provide the acoustic apparatus of the equipment producing the sound of high quality. In case of the video equipment, since the vibration of the panel portion is prevented, a picture screen of the CRT does not vibrate, thereby making the deterioration of the picture quality of the video equipment to be prevented and making the sound wave to effectively be emitted from the speaker. This allows saving energy to be expected.

The present invention is not limited to the above-described embodiments.

For example, while, in the embodiment according to the present invention, the acoustic apparatus 10 is installed in one side and the other side of the cabinet 2 of the video equipment, it may of course be installed in one side only with no problem. Also, the acoustic apparatus 10 may be installed in a lower part and an upper part of the cabinet 2.

While, in the embodiment according to the present invention, the acoustic apparatus 10 of the equipment comprises one woofer 4 and one tweeter 5, the acoustic apparatus of the equipment may comprise one woofer 4 and two tweeters 5, for example.

Further, while, in the embodiment according to the present invention, the woofer 4 and the tweeter 5 are employed, the woofer 4 may be divided into a low range speaker and a middle range speaker for making a three way system.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. An audio apparatus for an equipment having a pair of low range speakers, a pair of high range speakers, and a display portion, comprising:

left and right lower panel portions forming a part of a casing of the equipment and each having a plurality of holes formed therein;

a sound conductor arranged between each of the pair of low range speakers and each of the lower panel portions, wherein front surfaces of the pair of low range speakers are arranged parallel to a front surface of the display portion a buffer member arranged between each sound conductor and each of the lower panel portions to absorb vibration from the pair of low range speakers; and left and right upper panel portions forming a part of the casing of the equipment and each having a plurality of holes formed therein, wherein an axis of each of the pair of high range speakers is arranged to be parallel to an axial direction of each of the plurality of holes formed in the upper panel portions, an axis of each of the pair of low range speakers is arranged to form an oblique angle with an axial direction of each of the plurality of holes formed in the lower panel portions so that a sound wave emanated by each of the pair of low range speakers is refracted when impinging the lower portions, and wherein the left lower panel portion and the left upper panel portion are inclined with respect to the right lower panel portion and the right upper panel portion in opposite directions forming an acute angle θ different than 0 with the front surface of the display portion.

2. The audio apparatus for an equipment according to claim 1, wherein the equipment is a video equipment.

3. The audio apparatus for an equipment according to claim 2, wherein the display portion of the video equipment is a cathode ray tube.

4. A video apparatus having a pair of low range speakers, a pair of high range speakers, and a display portion, comprising:

left and right lower panel portions forming a part of a casing of said apparatus and each having a plurality of holes formed therein;

a sound conductor arranged between each of the pair of low range speakers and each of the lower panel portions, wherein front surfaces of the pair of low range speakers are arranged parallel to a front surface of the display portion;

a buffer member arranged between each sound conductor and each of the lower panel portions to absorb vibration of the pair of low range speakers; and left and right upper panel portions forming a part of the casing of said apparatus and each having a plurality of holes formed therein, wherein an axis of each of the pair of high range speakers is arranged to be parallel to an axial direction of each of the plurality of holes of the upper panel portions, an axis of each of the pair of low range speakers is arranged to form an oblique angle with an axial direction of each of the plurality of holes formed in the lower panel portions so that a sound wave emanated by each of the pair of low range speakers is refracted when impinging the lower panel portions, and the left lower panel portion and the left upper panel portion are inclined with respect to the right lower panel portion and the right upper panel portion in opposite directions forming an acute angle e different than 0 with a front surface of the display portion.

5. The video apparatus according to claim 4, wherein the display portion is a cathode ray tube.

* * * * *